United States Patent [19]

Chang et al.

[11] Patent Number: 4,613,480

[45] Date of Patent: Sep. 23, 1986

[54] TRI-NICKEL ALUMINIDE COMPOSITION PROCESSING TO INCREASE STRENGTH

[75] Inventors: Keh-Minn Chang, Schenectady; Shyh-Chin Huang, Latham; Alan I. Taub, Schenectady, all of N.Y.

[73] Assignee: General Electric Company, Schenectady, N.Y.

[21] Appl. No.: 783,581

[22] Filed: Oct. 3, 1985

[51] Int. Cl.[4] ..... B22F 1/00

[52] U.S. Cl. ..... 419/30; 75/0.5 C; 75/82; 75/246; 148/11.5 N; 148/11.5 P; 148/126.1; 148/162; 148/409; 148/429; 419/38; 419/49; 419/62; 419/66; 419/68; 420/460; 420/590

[58] Field of Search ..... 419/30, 38, 49, 62, 419/66, 68; 420/460, 590; 75/0.5 C, 82, 246; 148/409, 429, 11.5 N, 11.5 P, 126.1, 162

[56] References Cited

U.S. PATENT DOCUMENTS

| | | | |
|---|---|---|---|
| 2,755,184 | 7/1956 | Turner et al. | 420/460 |
| 3,653,976 | 4/1972 | Miller et al. | 420/460 |
| 3,902,900 | 9/1975 | Restall et al. | 420/449 |
| 3,922,168 | 11/1975 | Restall et al. | 420/448 |
| 4,379,720 | 4/1983 | Ray et al. | 420/460 |
| 4,478,791 | 10/1984 | Huang et al. | 420/449 |

OTHER PUBLICATIONS

C. T. Liu & C. C. Koch, "Development of Ductile Polycrystalline $Ni_3Al$ For High-Temperature Applications", Technical Aspects of Critical Materials Use by the Steel Industry, NBSIR 83-2679-2, vol. IIB, (Jun. 1983), Center for Materials Science, U.S. Dept. of Commerce, Nat'l. Bureau of Standards.

*Primary Examiner*—Stephen J. Lechert, Jr.
*Attorney, Agent, or Firm*—Paul E. Rochford; James C. Davis, Jr.; Paul R. Webb, II

[57] ABSTRACT

Improvements in the strength of atomized and consolidated boron doped tri-nickel aluminides are made possible. The improved strength is achieved by cold rolling and annealing a HIPped aluminide. The improvements are to room temperature properties.

11 Claims, No Drawings

TRI-NICKEL ALUMINIDE COMPOSITION PROCESSING TO INCREASE STRENGTH

CROSS-REFERENCE TO RELATED APPLICATION

Applicants draw attention to copending application Ser. No. 783,582, filed 10-3-85, assigned to the same assignee as the subject application. The copending application is incorporated herein by reference.

BACKGROUND OF THE INVENTION

The present invention relates generally to compositions having a nickel aluminide base and their processing to improve their properties. More specifically, it relates to tri-nickel aluminide base materials which may be processed into useful articles which have increased strength at room temperatures.

It is known that unmodified polycrystalline tri-nickel aluminide castings exhibit properties of extreme brittleness, low strength and poor ductility at room temperature.

The single crystal tri-nickel aluminide in certain orientations does display a favorable combination of properties at room temperature including significant ductility. However, the polycrystalline material which is conventionally formed by known processes does not display the desirable properties of the single crystal material and, although potentially useful as a high temperature structural material, has not found extensive use in this application because of the poor properties of the material at room temperature.

It is known that nickel aluminide has good physical properties at temperatures up to about 1100° F. (600° C.) and could be employed, for example, in jet engines as component parts at operating or higher temperatures. However, if the material does not have favorable properties at lower temperature, the aluminide may break when subjected to stress at such lower temperatures at which the part would be maintained prior to starting the engine or prior to operating the engine at the higher temperatures above 1000° C. Any processing of such aluminides which significantly increases strength measured at room temperature while maintaining adequate ductility is valuable.

Alloys having a tri-nickel aluminide base are among the group of alloys known as heat-resisting alloys or superalloys. Some of these alloys are intended for very high temperature service where relatively high stresses such as tensile, thermal, vibratory and shock are encountered and where oxidation resistance is frequently required. Such alloys having good combinations of properties at temperatures up to about 1100° F. are highly useful.

Accordingly, what has been sought in the field of superalloys is an alloy composition which displays favorable stress resistant properties not only at the elevated temperatures up to about 1100° F. at which it may be used, as for example in a jet engine, but also a practical and desirable and useful set of properties at the lower temperatures to which the engine is subjected in storage and during warm-up operations.

Significant efforts have been made toward producing a tri-nickel aluminide and similar superalloys which may be useful over such a wide range of temperature and adapted to withstand the stress to which the articles made from the material may be subjected in normal operations over such a wide range of temperatures. The first set of problems of low strength and ductility at room temperature, that is in making such materials available, have been largely solved.

For example, U.S. Pat. No. 4,478,791, assigned to the same assignee as the subject application, teaches a method by which a significant measure of ductility can be imparted to a tri-nickel aluminide base metal at room temperature to overcome the brittleness of this material.

Also, copending applications of the same inventors as the subject application, Ser. Nos. 647,326 647,327; 647,328; 646,877 and 646,879 filed Sept. 4, 1984 teach methods by which the composition and methods of U.S. Pat. No. 4,478,791 may be further improved. These applications are incorporated herein by reference. These and similar inventions have essentially solved the basic problems of achieving high strength and ductility at lower temperatures such as room temperature. Also, there is extensive other literature dealing with tri-nickel aluminide base compositions.

For the unmodified binary intermetallic, there are many reports in the literature of a strong dependence of strength and hardness on compositional deviations from stoichiometry. E. M. Grala in "Mechanical Properties of Intermetallic Compounds", Ed. J. H. Westbrook, John Wiley, New York (1960) p. 358, found a significant improvement in the room temperature yield and tensile strength in going from the stoichiometric compound to an aluminum-rich alloy. Using hot hardness testing on a wider range of aluminum compositions, Guard and Westbrook found that at low homologous temperatures, the hardness reached a minimum near the stoichiometric composition, while at high homologous temperature the hardness peaked at the 3:1 Ni:Al ratio. TMS-AIME Trans. 215 (1959) 807. Compression tests conducted by Lopez and Hancock confirmed these trends and also showed that the effect is much stronger for Al-rich deviations than for Ni-rich deviations from stoichiometry. Phys. Stat. Sol. A2 (1970) 469. A review by Rawlings and Staton-Bevan concluded that in comparison with Ni-rich stoichiometric deviations, Al-rich deviations increase not only the ambient temperature flow stress to a greater extent, but also that the yield stress-temperature gradient is greater. J. Mat. Sci. 10 (1975) 505. Extensive studies by Aoki and Izumi report similar trends. Phys. Stat. Sol. A32 (1975) 657 and Phys. Stat. Sol. A38 (1976) 587. Similar studies by Noguchi, Oya and Suzuka also reported similar trends Met. Trans. 12A (1981) 1647.

More recently, an article by C. T. Liu, C. L. White, C. C. Koch and E. H. Lee appearing in the "Proceedings of the Electrochemical Society on High Temperature Materials", ed. Marvin Cubicciotti, Vol. 83-7, Electrochemical Society, Inc. (1983) p. 32, discloses that the boron induced ductilization of the same alloy system is successful only for aluminum lean $Ni_3Al$.

The subject application presents a further improvement in the nickel aluminide to which significant increased strength at lower temperatures has been imparted and particularly improvements in the strength of tri-nickel aluminide base compositions in the temperature range below about 600° C.

It should be emphasized that materials which exhibit good strength and adequate ductility are very valuable and useful in applications below about 600° C. 600° C. is about 1137.6° F. There are many applications for strong oxidation resistant alloys at temperature of 1100° F. and below. The tri-nickel aluminide alloys which have appreciable ductility and good strength at room temperatures and which have oxidation resistance and good strength and ductility at temperatures up to about 1100° F. are highly valuable for numerous structural applications in high temperature environments.

BRIEF SUMMARY OF THE INVENTION

It is accordingly one object of the present invention to provide a method of improving the properties of articles adapted to use in structural parts at room temperature as well as at elevated temperatures up to about 1100° F.

Another object is to provide an article suitable for withstanding significant degrees of stress and for providing appreciable ductility at room temperature as well as at elevated temperatures of up to about 1100° F.

Another object is to provide a consolidated material which can be formed into useful parts having the combination of properties of significant strength and ductility at room temperature and at elevated temperatures of up to about 1100° F.

Another object is to provide a consolidated tri-nickel aluminide material which has a desirable combination of strength and ductility at room temperature.

Another object is to provide parts consolidated from powder which have a set of properties useful in applications such as jet engines and which may be subjected to a variety of forms of stress.

Other objects will be in part apparent and in part set forth in the description which follows.

In one of its broader aspects an object of the present invention may be achieved by providing a melt having a tri-nickel aluminide base and containing a relatively small percentage of boron and which may contain one or more substituents for the nickel or for the aluminum as pointed out in the copending applications referenced above. The melt is then atomized by inert gas atomization. The melt is rapidly solidified to powder during the atomization. The material is then consolidated by hot isostatic pressing at a temperature of about 1150° C. and at about 15 ksi for about two hours. The isostatically pressed sample is cold rolled to impart a set of significantly improved properties to the sample.

Although the melt referred to above should ideally consist only of the atoms of the intermetallic phase and substituents as well as atoms of boron, it is recognized that occasionally and inevitably other atoms of one or more incidental impurity atoms may be present in the melt.

As used herein the expression tri-nickel aluminide base composition refers to a tri-nickel aluminide which contains impurities which are conventionally found in nickel aluminide compositions. It includes as well other constituents and/or substituents which do not detract from the unique set of favorable properties which are achieved through practice of the present invention. Substituents as taught in the copending applications referenced above are included herein.

DETAILED DESCRIPTION OF THE INVENTION

In the case of the superalloy system $Ni_3Al$ or the tri-nickel aluminide base superalloy, the ingredient or constituent metals are nickel and aluminum. The metals are present in the stoichiometric atomic ratio of 3 nickel atoms for each aluminum atom in this system.

Nickel aluminide is found in the nickel-aluminum binary system and as the gamma prime phase of conventional gamma/gamma prime nickel-base superalloys. Nickel aluminide has high hardness and is stable and resistant to oxidation and corrosion at elevated temperatures which makes it attractive as a potential structural material.

Nickel aluminide, which has a face centered cubic (FCC) crystal structure of the $Cu_3Al$ type ($Ll_2$ in the Stukturbericht designation which is the designation used herein and in the appended claims) with a lattice parameter $a_o=3.589$ at 75 at. % Ni and melts in the range of from about 1385° to 1395° C., is formed from aluminum and nickel which have melting points of 660° and 1453° C., respectively. Although frequently referred to as $Ni_3Al$, tri-nickel aluminide is an intermetallic phase and not a compound as it exists over a range of compositions as a function of temperature, e.g., about 72.5 to 77 at. % Ni (85.1 to 87.8 wt. %) at 600° C.

Polycrystalline Ni3Al by itself is quite brittle and shatters under stress as applied in efforts to form the material into useful objects or to use such an article.

It was discovered that the inclusion of boron in the rapidly cooled and solidified alloy system can impart desirable ductility to the rapidly solidified alloy as taught in U.S. Pat. No. 4,478,791.

It has been discovered that certain metals can be beneficially substituted in part for the constituent metal nickel or for the constituent metal aluminum. This substituted metal is designated and known herein as a substituent metal, i.e. as a nickel substituent in the $Ni_3Al$ structure or an aluminum substituent. The beneficial incorporation of substituent metals in tri-nickel aluminide to form tri-nickel aluminide base compositions is disclosed and described in the copending applications referenced above.

By a substituent metal is meant a metal which takes the place of and in this way is substituted for another and different ingredient metal, where the other ingredient metal is part of a desirable combination of ingredient metals which ingredient metals form the essential constituents of an alloy system.

Moreover, it has been discovered that valuable and beneficial properties are imparted to the rapidly solidified compositions which have the stoichiometric proportions but which have a substituent cobalt metal as a quaternary ingredient of such a rapidly solidified alloy system. This discovery is described in copending application Ser. No. 647,326 filed Sept. 9, 1984 and assigned to the same assigned as the subject application. This application is referenced above and has been incorporated herein by reference. Alloy T-19 below is such an alloy containing substituent cobalt.

The alloy compositions of the prior and also of the present invention must also contain boron as a tertiary ingredient as taught herein and as taught in U.S. Pat. No. 4,478,791. A preferred range for the boron tertiary additive is between 0.2 and 1.5%.

By the prior teaching of U.S. Pat. No. 4,478,791, it was found that the optimum boron addition was in the range of 1 atomic percent and permitted a yield strength value at room temperature of about 100 ksi to be achieved for the rapidly solidified product. The fracture strain of such a product was about 10% at room temperature.

The composition which is formed must have a preselected intermetallic phase having a crystal structure of the $Ll_2$ type and must have been formed by cooling a melt at a cooling rate of at least about $10^3$°C. per second to form a solid body the principal phase of which is of the $Ll_2$ type crystal structure in either its ordered or disordered state.

The alloys prepared according to the teaching of U.S. Pat. No. 4,478,791 as rapidly solidified cast ribbons have been found to have a highly desirable combination of strength and ductility. The ductility achieved is particularly significant in comparison to the zero level of ductility of previous samples.

However, it was found that annealing of the cast ribbons led to a loss of ductility. An annealing embrittlement was observed. It is described in copending application Ser. No. 782,718, filed 10-13-85 the text of which application is incorporated herein by reference. Such annealing embrittlement leads to a low temperature brittleness.

A significant advance in overcoming the annealing embrittlement is achieved by preparing a specimen of tri-nickel aluminide base alloy through a combination of atomization and consolidation techniques. This is also described in the copending application Ser. No. 783,718, filed 10-13-85.

We have discovered that the properties, and particularly the strength of an article prepared by a combination of atomization and consolidation, can be substantially improved through mechanical and thermomechanical processing steps.

EXAMPLE 1

A set of tri-nickel aluminide base alloys were each individually vacuum induction melted to form a ten pound heat. The compositions of the alloys are listed in Table I below.

TABLE I

| Alloy | Ni | Co | Al | B |
|---|---|---|---|---|
| T-18 | bal. | — | 24.77 | 0.93 |
| T-19 | bal. | 9.91 | 24.75 | 0.98 |
| T-56 | bal. | — | 23.82 | 0.75 |

The ingots formed from the vacuum melting were re-melted and were then atomized in argon. The atomization was carried out in accordance with one or more of the methods taught in copending applications for patent of S. A. Miller, Ser. Nos. 584,687; 584,688; 584,689; 584,690 and 584,691, filed Feb. 28, 1984 and assigned to the assignee of this application. These applications are incorporated herein by reference. Other and conventional atomization processes may be employed to form rapidly solidified powder to be consolidated. The powder produced was screened and the fraction having particle sizes of −100 mesh or smaller were selected.

The selected powder was sealed into a metal container and HIPped. The HIP process is a hot-isostatic-pressing process for consolidating powders as known in the art. In this example, the selected powder specimens were HIPped at about 1150° C. and at about 15 ksi pressure for a period of about 2 hours.

Most mechanical properties of the consolidated specimens were evaluated in the as-HIP condition. The results are set forth in Table II below.

In the tables and other presentation of data which follows, the abbreviations used and their meanings are as follows: Y.S. is yield strength in ksi; ksi is thousand pounds per square inch; T.S. is tensile strength in ksi; U.L. is uniform elongation in percent; uniform elongation is the elongation as measured at the point of maximum strength of a test sample; E.L. is total elongation in percent; total elongation is the amount of elongation of a test specimen at the point of failure. Where E.L. is greater than U.L., this is an indication that necking has occurred.

TABLE II

| Room Temperature Properties of as HIPped Samples | | | |
|---|---|---|---|
| Alloy Sample | T-18 | T-19 | T-56 |
| Y.S. (ksi) | 72 | 79 | 66 |
| T.S. (ksi) | 138 | 203 | 193 |
| E.L. (%) | 13 | 35 | 45 |
| U.L. (%) | 13 | 35 | 42 |

Each of these samples has a desirable combination of strength and ductility properties at room temperature or at about 20° C. These properties are the standards against which the samples prepared by the examples below are compared.

EXAMPLE 2

A set of three samples of as-HIPped alloys prepared as described in Example 1 were annealed. The physical properties of the annealed samples were tested and are listed with those of the as-HIPped samples in Tables IIIB, C and D below. Table IIIA lists HIPping and annealing temperatures for the specimens and Table IIIB, Table IIIC and Table IIID list room temperature properties for samples T-18, T-19 and T-56, respectively.

The latter tables list measurements of mechanical properties taken at room temperature.

TABLE IIIA

| Temperature of HIP and of HIP and Anneal of Sample Specimens | | | |
|---|---|---|---|
| | T-18 | T-19 | T-56 |
| HIP Temp: | 1165° C. | 1143° C. | 1150° C. |
| Anneal Temp: | 1000° C. | 1000° C. | 1000° C. |
| Anneal Time: | 2 hrs. | 2 hrs. | 1 hr. |

TABLE IIIB

| Room Temperature Properties of as-HIPped and of HIPped and annealed specimens of T-18 Alloy | | | | |
|---|---|---|---|---|
| | YS | TS | UL | EL |
| T-18 as HIP | 72 | 138 | 13 | 13 |
| T-18 HIP and anneal | 72 | 154 | 17 | 17 |

TABLE IIIC

| Room Temperature Properties of as-HIPped and of HIPped and Annealed Specimens of T-19 Alloy | | | | |
|---|---|---|---|---|
| | YS | TS | UL | EL |
| T-19 as HIP | 79 | 203 | 35 | 35 |
| T-19 HIP and anneal | 84 | 203 | 33 | 33 |

TABLE IIID

| Room Temperature Properties of as-HIPped and of HIPped and Annealed Specimens of T-56 Alloy | | | | |
|---|---|---|---|---|
| | YS | TS | UL | EL |
| T-56 as HIP | 66 | 193 | 42 | 45 |
| T-56 HIP and anneal | 66 | 192 | 41 | 46 |

It is evident that whereas there was no significant change of property values for the T-56 and T-19 specimens, the T-18 specimen did show a minor ductility improvement and tensile improvement to result from the anneal.

EXAMPLE 3

Consolidated specimens of the T-18 alloy powder prepared as described in Example 1 were subjected to various combinations of heating, cooling and cold working and to various sequences of heating, cooling and cold working.

In this example, the specimens of T-18 referenced in Example 1 were treated and tested as set forth in Table IV below.

The steps applied are listed under the heading *Processing Conditions* and the values of the physical properties found are also listed in the accompanying Table IV.

TABLE IV

Effect of Thermo-Mechanical Processing on Room Temperature Tensile Properties of Alloy T-18

| Processing Condition | Y.S. (ksi) | T.S. (ksi) | E.L. (%) |
|---|---|---|---|
| As-HIPped (at 1165° C. and 15 ksi for 2 hours) | 72 | 138 | 13 |
| HIPped and annealed at 1100° C. for 2 hours and salt bath quenched | 73 | 85 | 3 |
| HIPped and annealed at 1000° C. for 2 hours | 72 | 154 | 17 |
| HIPped and cold rolled 20% and 1150° C. annealed for 1 hour and water quenched | 73 | 181 | 28 |
| HIPped and cold rolled 20% and 1150° C. annealed for 2 hours and chamber cooled | 73 | 194 | 36 |
| HIPped and cold rolled 20% and 1150° C. annealed for 1 hour and furnace cooled | 73 | 183 | 30 |
| HIPped and cold rolled 20% and 1000° C. annealed for 24 hours and chamber cooled | 73 | 194 | 33 |

It is evident from the property values listed in the above table that significant improvements of about ¼ in strength and about twofold in ductility can be achieved through a combination of cold working and annealing of boron doped tri-nickel aluminide base alloys which have been atomized from a melt to powder and which have then been consolidated by HIPping.

Tensile elongation at room temperature is remarkably good for all samples to which thermo-mechanical processing steps were applied. Consequently, a much higher ultimate tensile strength (TS) is observed in the thermo-mechanically processed materials although their yield strength (YS) remains at the same level as that of the as-HIPped material.

EXAMPLE 4

Consolidated specimens of T-19 alloy powders prepared as described in Example 1 were subjected to various combinations of heating, cooling and cold working and to various sequences of heating, cooling and cold working.

In this example the specimens of T-19 referenced in Example 1 were treated and tested as set forth in Table V below.

TABLE V

Effect of Thermo-Mechanical Processing on Room Temperature Tensile Properties of Alloy T-19

| Processing Condition | Y.S. (ksi) | T.S. (ksi) | U.L. (%) | E.L. (%) |
|---|---|---|---|---|
| As HIPped (at 1143° C. and 15 ksi for 2 hours) | 79 | 203 | 35 | 35 |

TABLE V-continued

Effect of Thermo-Mechanical Processing on Room Temperature Tensile Properties of Alloy T-19

| Processing Condition | Y.S. (ksi) | T.S. (ksi) | U.L. (%) | E.L. (%) |
|---|---|---|---|---|
| HIPped and annealed at 1000° C. for 2 hours and salt-bath quench | 84 | 203 | 33 | 33 |
| HIPped cold rolled 25%, annealed at 1000° C. for 1 hour and chamber cooled | 87 | 208 | 40 | 42 |
| HIPped cold rolled 25% and annealed at 1000° C. for 24 hours and chamber cooled | 85 | 205 | 40 | 42 |
| HIPped cold rolled 25% and annealed at 800° C. for 24 hours and chamber cooled | 85 | 205 | 40 | 41 |

From the results plotted in Table V, it is evident that moderate increase of the order of one sixth in both U.L. and E.L. are achieved by a combination of cold working and annealing. More significantly, the cold rolled and annealed samples exhibit necking as evidenced by the higher value of E.L. for each sample as compared to U.L. Further, this is accomplished with no loss and even a minor gain in strength. The gains are not lost as a result of longer anneals of the order of 24 hours.

EXAMPLE 5

As stated above, the tri-nickel aluminide base compositions have a $Ll_2$ type structure. They are single phase, ordered, face-centered cubic (FCC) alloys.

In order to provide a comparison with other single phase FCC alloys a table of the respective mechanical properties of different specimens of these alloys is compiled here. The listed properties are the yield strength (Y.S. in ksi), the tensile strength (T.S. in ksi) and the strain hardening rate (dS/de in ksi) for each of four distinctly different single phase face centered cubic species of alloys. The values are set forth in Table VI as follows:

TABLE VI

Comparison of Room Temperature Tensile Behaviors of Single Phase, FCC Alloys

| Alloy Type | Y.S. (ksi) | T.S. (ksi) | dS/de (ksi) |
|---|---|---|---|
| 304 Stainless Steel (Fe—Cr—Ni) | 35 | 85 | 210 |
| Hastealloy C (Ni—Cr—Mo) | 58 | 120 | — |
| Hadfield Steel (Fe—Mn—C) | 55 | 140 | 300 |
| As HIPped Boron Doped $Ni_3Al$ T-56 | 66 | 193 | 600 |

EXAMPLE 6

Consolidated specimens of T-19 alloy powder prepared as described in Example 1 were cold rolled through a reduction of about 25% but were not annealed. Tensile values were dramatically increased as a result of the cold rolling as evident from Table VII below.

In carrying out the present invention the alteration of the physical properties of various tri-nickel aluminide compositions by cold working can be controlled by the degree of cold working which is imparted to the specimen under test.

Referring to Table VII, it is evident that the yield strength of a specimen of the T-19 alloy has a strikingly higher value where a 25% cold work without anneal is imparted to the specimen. The yield strength value for the cold worked T-19 alloy reaches to about 250 ksi level, which is among the highest values reported for bulk ductile FCC single phase alloys. Though the elongation value is relatively low because of the increase in strength, the ductility is adequate as shown by the necking of the specimen.

TABLE VII

Room Temperature Tensile Properties of Specimens of Alloy T-19 After 25% Cold Working In Comparison to as HIPping

| | YS | TS | UL | EL |
|---|---|---|---|---|
| As HIPped | 79.0 | 203.2 | 35.3 | 35.3 |
| Cold work 25% | 250.0 | 267.5 | 2.3 | 2.6 |
| Cold work 25% | 247.5 | 267.5 | 3.5 | 5.1 |

The foregoing results make amply clear that substantial alteration of the room temperature properties of atomized and consolidated boron doped tri-nickel aluminides is feasible by employing the steps and methods of the present invention.

It is one of the unique findings of the present invention that the room temperature tensile strength of a boron doped tri-nickel aluminide of a broad range of compositions may be improved by preparing a melt of a tri-nickel aluminide containing 0.2 to 1.5 atomic percent boron, rapidly solidifying the melt to a powder by gas atomization, consolidating the powder to a solid body by high temperature isostatic pressing and by then cold working the consolidated body.

EXAMPLE 7

An ingot was formed by vacuum melting to have the following composition as set out in Table VIIIA. The concentrations indicated are based on quantities of ingredients added.

TABLE VIIIA

| Alloy | Nickel | Cobalt | Aluminum | Boron |
|---|---|---|---|---|
| T-6 | Balance | 9.93 | 23.82 | 0.75 |

The melt was atomized and collected as a dense body on a cold collecting surface according to a spray forming process. One such spray forming process is disclosed in U.S. Pat. Nos. 3,826,301 and 3,909,921. Other processes may also be employed. The deposit formed was removed and subjected to a series of treatments including thermal and thermo-mechanical processing.

As for each of the processing steps of this and the other examples above, a test specimen was prepared from the material following each step of processing so that changes in mechanical properties could be determined as they are modified by each processing stage. The processing steps and the test results determined following each processing step are listed in Table VIIIB below.

TABLE VIIIB

Mechanical Properties At Room Temperature of Spray Formed Sample (Strain Rate 0.11 $Min^{-1}$)

| Condition | YS (ksi) | TS (ksi) | E.L. (%) | U.L. (%) |
|---|---|---|---|---|
| Two-hour anneal at 1000° C. | 58 | 174 | 29 | 29 |
| Cold work 38% followed by 2-hour anneal at | 62 | 188 | 42 | 39 |

TABLE VIIIB-continued

Mechanical Properties At Room Temperature of Spray Formed Sample (Strain Rate 0.11 $Min^{-1}$)

| Condition | YS (ksi) | TS (ksi) | E.L. (%) | U.L. (%) |
|---|---|---|---|---|
| 1000° C. | | | | |
| Cold work 27% followed by 2-hour anneal at 1100° C. | 61 | 184 | 38 | 36 |
| Cold work 27% 2-hour anneal at 1100° C. cold work 24% 2-hour anneal at 1000° C. | 58 | 188 | 41 | 38 |

As is evident from the data recorded in Table VIIIB, the properties of the sample are greatly improved as a result of the cold working practice of the present invention.

As is evident from the foregoing, substantial improvement in room temperature physical properties of a tri-nickel aluminide base composition is made possible by the practice of this invention. The invention includes the step of atomizing a boron doped tri-nickel aluminum base melt and forming a consolidated body from the atomized melt.

The formation of the consolidated body is described above in terms of HIPping. However, other methods of forming a consolidated body may also be employed. For example, a consolidated body may be formed by a spray forming process. One such spray forming process is described in the U.S. Pat. Nos. 3,826,301 and 3,909,921. Other spray forming processes by which a melt stream being atomized is intercepted and rapidly solidified on a receiving surface to form a consolidated body may be used as well.

The subject method is applicable to boron doped and tri-nickel aluminide base compositions, the tri-nickel aluminide of alloy T-19 is a tri-nickel aluminide base composition inasmuch as the cobalt of the composition is included as a substituent for nickel. As the term tri-nickel aluminide base composition is used herein, it includes compositions which contain such nickel substituents as cobalt as well as such aluminum substituents as vanadium, silicon, niobium, tantalum, and titanium.

The concentration of such substituents are concentrations which do not detract from the properties of the boron doped tri-nickel aluminide base or from the improvements to those properties made possible by this invention. For example, the nickel substituents such as cobalt is preferably included to the extent of 0.05 to 0.30 in the expression which follows. Other permissible concentration ranges of the other ingredients are set forth following the expression.

$$[(Ni_{1-a}M_a)_{1-x}(Al_{1-b}\overline{M}_b)_x]_{100-y}B_y$$

where

M is a substituent for nickel a has a value between 0.0 and 0.3 and is preferably between about 0.05 and 0.15

$\overline{M}$ is a substituent for aluminum b has a value between 0.0 and 0.10 and is preferably between about 0.01–0.07 x has a value between 0.23 and 0.25 and is preferably about 0.24 y has a value between 0.2 and 1.50 and is preferably between 0.2 and 1.0.

A principal advantage of practice of the present invention is in improving the mechanical properties of atomized and consolidated tri-nickel aluminide base compositions by a thermomechanical processing of the boron doped tri-nickel aluminide. Greater advantages are derived by the processing compositions which are simple boron doped $Ni_3Al$ with no substituents. One such composition is T-18 which has essentially a stochiometric ratio of nickel and aluminum. Another is T-56 which is a nickel rich composition in which the nickel concentration 1-x in the above expression is above 0.75 and the aluminum concentration, x, is below 0.25.

What is claimed and sought to be protected by Letters Patent of the United States is as follows:

1. A method of improving the room temperature properties of a tri-nickel aluminide base composition which comprises preparing a melt of a boron doped tri-nickel aluminide according to the expression $$[(Ni_{1-a}M_a)_{1-x}(Al_{1-b}\overline{M}_b)_x]_{100-y}B_y$$

where

M is a substituent metal for nickel;

a has a value between 0.0 and 0.30;

$\overline{M}$ is a substituent for aluminum;

b has a value between 0.0 and 0.10;

x has a value between 0.23 and 0.25; and y has a value between 0.2 and 1.50, atomizing the melt to rapidly solidify the melt to powder particles having $Ll_1$ type crystal structure, forming a consolidated body of said particles to retain the $Ll_2$ type crystal structure, and cold working the body to deform it by more than 5%.

2. The method of claim 1 in which the substituent M is cobalt.

3. The method of claim 1 in which the substituent $\overline{M}$ is at least one metal selected from the group consisting of silicon, vanadium, tantalum, titanium, and niobium.

4. The method of claim 1 in which the value of a is between about 0.05 and 0.15.

5. The method of claim 1 in which b has a value between 0.01 and 0.07.

6. The method of claim 1 in which x has a value between 0.235 and 0.245.

7. The method of claim 1 in which the value of y is between 0.2 and 1.0.

8. The method of claim 1 in which the formation of the consolidated body is by spray forming.

9. The method of claim 1 in which the formation of the consolidated body is by hot isostatic pressing.

10. The method of claim 1 in which the deformation of the body is in excess of 10%.

11. The method of claim 1 in which the deformation of the body is about 25%.

* * * * *